United States Patent [19]

Inaga et al.

[11] 4,413,705

[45] Nov. 8, 1983

[54] EXHAUST MUFFLER FOR A TWO-CYCLE OPPOSED CYLINDER ENGINE

[75] Inventors: Hisashi Inaga, Tokyo; Takashi Fukuoka, Fuchu, both of Japan

[73] Assignee: Kioritz Corporation, Japan

[21] Appl. No.: 326,774

[22] Filed: Dec. 2, 1981

[30] Foreign Application Priority Data

Dec. 25, 1980 [JP] Japan ..... 55-185649[U]

[51] Int. Cl.[3] ..... F01N 1/08

[52] U.S. Cl. ..... 181/240; 181/238; 181/272; 181/281; 30/381

[58] Field of Search ..... 181/206, 229, 230, 238, 181/240, 255, 272, 274, 275, 281; 30/381-383

[56] References Cited

U.S. PATENT DOCUMENTS 3,650,354 3/1972 Gordon ..... 181/240

4,178,685 12/1979 Inaga ..... 30/381

FOREIGN PATENT DOCUMENTS 55-47214 11/1980 Japan .

*Primary Examiner*—Benjamin R. Fuller

*Attorney, Agent, or Firm*—Karl W. Flocks; A. Fred Starobin

[57] ABSTRACT

An exhaust muffler for a two-cycle opposed cylinder engine of simultaneous ignition type having two cylinders opposing to each other in the horizontal direction. The muffler has conical members disposed to oppose to exhaust ports of the cylinders, the exhaust ports being arranged in a side-by-side relation. The conical members form conical annular discharge passages leading from respective exhaust ports. The discharge passages have flattened peripheral outlets of different opening areas. The flows of the exhaust gas from respective cylinders are introduced through the flattened peripheral outlets of the discharge passages into a common diffusion chamber, so that the attenuation of the pressure waves and release of heat of exhaust gas are promoted to reduce the exhaust noise of the engine.

1 Claim, 1 Drawing Figure

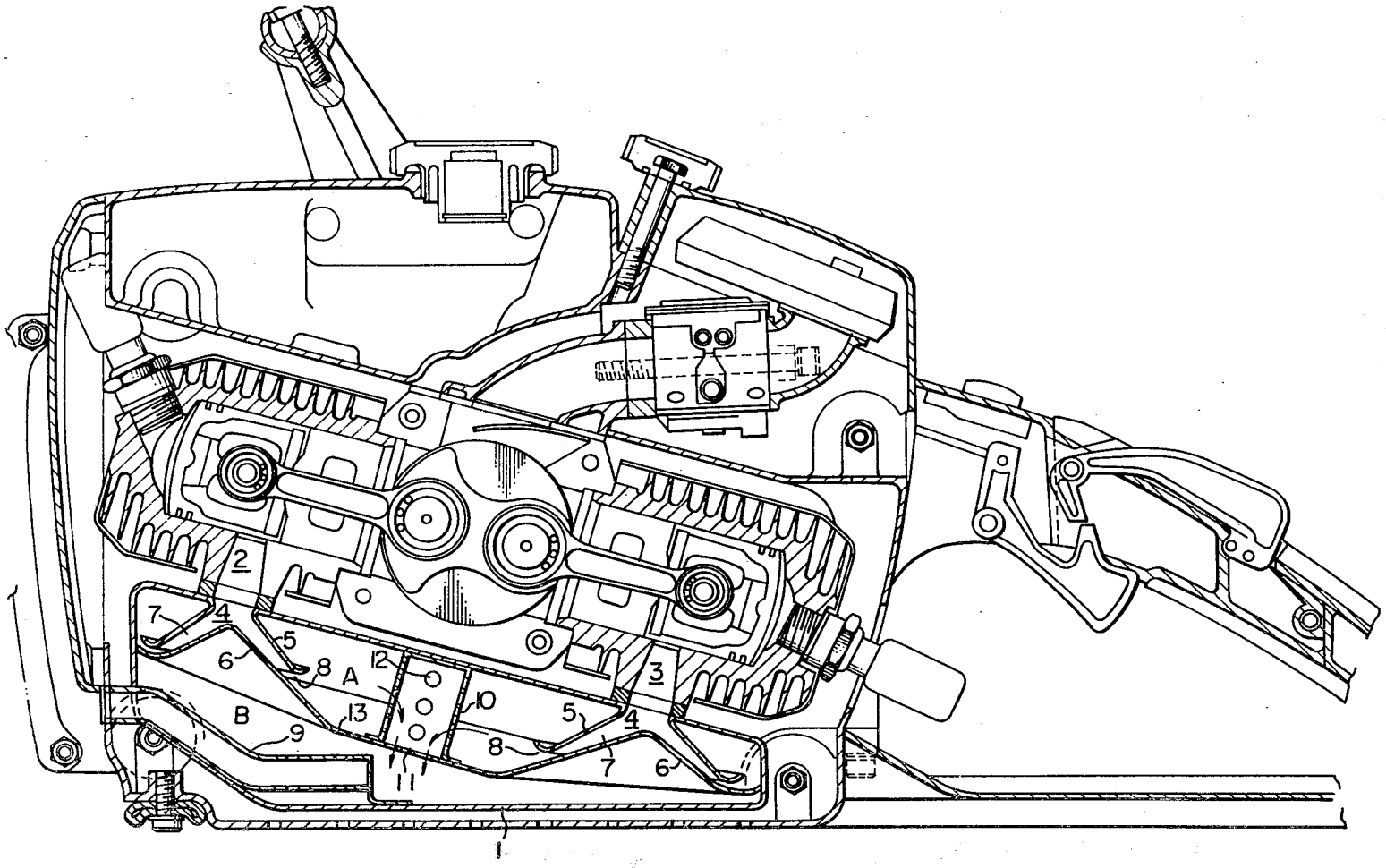
1
2
3
4
5
6
7
8
9
10
11
12
13
A
B

EXHAUST MUFFLER FOR A TWO-CYCLE OPPOSED CYLINDER ENGINE

BACKGROUND OF THE INVENTION

The present invention relates to an exhaust muffler suitable for use in a two-cycle opposed cylinder engine of simultaneous ignition type having two cylinders opposing to each other in horizontal direction.

The present inventor has already proposed a muffler for single cylinder engines, in Japanese Patent Publication No. 47214/1980. The present invention is to improve this muffler to make it adaptable to dual cylinder engines. According to the invention, it is possible to reduce the noise emitted from the engine by making the pressure waves of the exhaust gases from both cylinders interfere with each other in a diffusion chamber of the muffler, while increasing the output of each cylinder.

SUMMARY OF THE INVENTION

Accordingly, an object of the invention is to provide a muffler for a two-cycle opposed cylinder engine of simultaneous ignition type having two cylinders opposing to each other in horizontal direction in which exhaust ports of two cylinders are arranged in a side-by-side relation and are connected to conical annular discharge passages having different opening areas. The exhaust gases from the both cylinders are discharged through these conical annular chambers into a common diffusion chamber so that the attenuation of the pressure waves and the reduction of the temperature of the exhaust gas are facilitated to lower the level of the exhaust gas noise.

Another object of the invention is to provide a muffler for dual cylinder engine having a diffusion chamber divided into a first diffusion chamber and a second diffusion chamber which are communicated with each other through an interference chamber and an aperture formed in a partition wall.

These and other objects, as well as advantageous features of the invention will become clear from the following description of the preferred embodiment taken in conjunction with the accompanying drawings.

BRIEF DESCRIPTION OF THE DRAWINGS

The attached sole FIGURE is a sectional view of an essential part of a chain saw having an engine incorporating a muffler in accordance with the invention.

DESCRIPTION OF THE PREFERRED EMBODIMENT

A preferred embodiment of the invention will be described hereinunder with reference to the attached FIGURE. This embodiment is applied to an internal combustion engine mounted on a chain saw. The engine is a two-cycle opposed cylinder internal combustion engine having two cylinders arranged to oppose to each other in the horizontal direction, the ignition taking place in both cylinders simultaneously. The chain saw has a centrifugal clutch device connected to one side of the engine, through which a saw chain is slidingly driven along a saw bar attached to the body to the chain saw. A carburetor, a fuel tank and so forth are arranged above these cylinders, while an oil tank is disposed at one side of these cylinders. A common muffler 1 is disposed in a comparatively large space defined beneath the cylinders. The chain saw is carried and handled by means of a front and rear handles connected to the front and rear sides of the body thereof. As is well known, the chain saw has to undergo severe regulations for limiting the vibration and noise levels.

The common muffler 1 is composed of two diffusion chambers A and B. The exhaust gas is discharged to the outside of the engine through the first chamber A, second chamber B and an exhaust pipe 9. The cylinders have exhaust ports 2, 3 arranged in side-by-side relation at one side of the common muffler 1. These exhaust ports 2, 3 are connected to the first diffusion chamber A. To the outlet side 4 of each exhaust port, attached is a member 5 having a form resembling an umbrella. A conical member 6 is disposed at the inner side of the umbrella-like member 5 to oppose to the latter thereby to form a conical annular discharge passage 7 therebetween. The conical annular passage 7 has a flat peripheral outlet 8 at the skirt portions of the members 5 and 6, so that the exhaust gas discharged from the exhaust port 2, 3 in the form of a column is changed into a flat disc-like form as the gas passes through the flat peripheral outlet 8 of the discharge passage 7. The area of the flat peripheral outlet 8 of the discharge passage 7 connected to the exhaust port 2 is different from that of the flat peripheral outlet 8 of the discharge passage 7 connected to the exhaust port 3.

Thus, the exhaust gases from two cylinders, having different waveforms of the pressure wave, are introduced into the common first diffusion chamber A and is led to the second diffusion chamber B through an interference chamber 10 formed at a substantially central portion of the first diffusion chamber A and then through apertures 12, 13 formed in the first diffusion chamber A and a partition wall 11 by which the first and second diffusion chambers A, B are separated from each other. The partition wall 11 may be integral with the conical members 6, 6 as illustrated or may be formed as a separate body from the conical members 6, 6. The provision of the interference member 10 is not essential. Namely, the interference chamber 10 may be omitted depending on the piston displacement of the engine. Also, the interference chamber 10 may be located at an offset from the illustrated central position.

Since the ignition takes place simultaneously in both cylinders as stated before, the exhaust gases are discharged from both exhaust ports 2, 3 simultaneously. The gas thus discharged in a columnar form from each exhaust port 2, 3 has a high temperature, as well as a large pressure energy and velocity. This exhaust gas is introduced into the conical annular discharge passage 7 defined between the umbrella-like member 5 and the conical member 6 having the substantially flat peripheral outlet 8. The columnar flow of the exhaust gas, therefore, is discharged and dispersed in a flattened form, as it leaves the flat peripheral outlet 8 of each conical annular discharge passage 7. Since the columnar flow of the exhaust gas is diverged into a thin doughnut-like form as it flows along the conical annular discharge passage 7, it is possible to remarkably decrease the energy of the pressure wave and the temperature of the exhaust gas by the time the gas reaches the flat peripheral outlet 8. In addition, since two flat peripheral outlets 8, 8 have different areas as stated before, an interference between the pressure waves takes place in the first diffusion chamber A to further attenuate the energy of pressure wave.

The influence on the engine output caused by this exhaust system is not so serious. Rather, by a suitable arrangement of the constituents of the muffler 1, it is easy to make it possible to create an increasing tendency of the engine output.

What is claimed is:

1. In a two-cycle opposed cylinder engine of simultaneous ignition type having two cylinders arranged to oppose each other in the horizontal direction, said cylinders having exhaust ports arranged in a side-by-side relation, an exhaust muffler comprising conical members disposed opposed to respective exhaust ports to form conical annular discharge passages leading from said exhaust ports, said conical annular discharge passages having outlets of different opening areas and opening to a common first diffusion chamber, a partition wall having an aperture, said partition wall defining an interference chamber disposed near the center of said first diffusion chamber, and a second diffusion chamber with which said first diffusion chamber communicates through said interference chamber and said aperture.

* * * * *